US008170885B2

(12) United States Patent
Kim et al.

(10) Patent No.: US 8,170,885 B2
(45) Date of Patent: May 1, 2012

(54) WIDEBAND AUDIO SIGNAL CODING/DECODING DEVICE AND METHOD

(75) Inventors: Hong Kook Kim, Gwangju (KR); Young Han Lee, Gwangju (KR)

(73) Assignee: Gwangju Institute of Science and Technology, Gwangju (KR)

( * ) Notice: Subject to any disclaimer, the term of this patent is extended or adjusted under 35 U.S.C. 154(b) by 816 days.

(21) Appl. No.: 12/252,330

(22) Filed: Oct. 15, 2008

(65) Prior Publication Data

US 2009/0138272 A1 May 28, 2009

(30) Foreign Application Priority Data

Oct. 17, 2007 (KR) ..... 10-2007-0104402

(51) Int. Cl.
*G10L 21/00* (2006.01)

(52) U.S. Cl. ..... 704/501; 704/201; 704/249; 704/222; 704/209; 381/22; 375/243; 375/242

(58) Field of Classification Search ..... 704/201, 704/249; 381/22; 375/243, 242
See application file for complete search history.

(56) References Cited

U.S. PATENT DOCUMENTS

| | | | | |
|---|---|---|---|---|
| 5,581,652 | A * | 12/1996 | Abe et al. | 704/222 |
| 2005/0163323 | A1* | 7/2005 | Oshikiri | 381/22 |
| 2007/0147518 | A1* | 6/2007 | Bessette | 375/243 |
| 2007/0271092 | A1* | 11/2007 | Ehara et al. | 704/209 |
| 2008/0027711 | A1* | 1/2008 | Rajendran et al. | 704/201 |
| 2008/0031365 | A1* | 2/2008 | Garudadri et al. | 375/242 |
| 2008/0172230 | A1* | 7/2008 | Hayakawa | 704/249 |

* cited by examiner

*Primary Examiner* — Michael Colucci

(57) ABSTRACT

Disclosed is a wideband audio signal coding/decoding device and method that may code a wideband audio signal while maintaining a low bit rate. The wideband audio signal coding device includes an enhancement layer that extracts a first spectrum parameter from an inputted wideband signal having a first bandwidth, quantizes the extracted first spectrum parameter, and converts the extracted first spectrum parameter into a second spectrum parameter; and a coding unit that extracts a narrowband signal from the inputted wideband signal and codes the narrowband signal based on the second spectrum parameter provided from the enhancement layer, wherein the narrowband signal has a second bandwidth smaller than the first bandwidth. The wideband audio signal coding/decoding device and method may code a wideband audio signal while maintaining a low bit rate.

21 Claims, 11 Drawing Sheets

[FIG. 1]
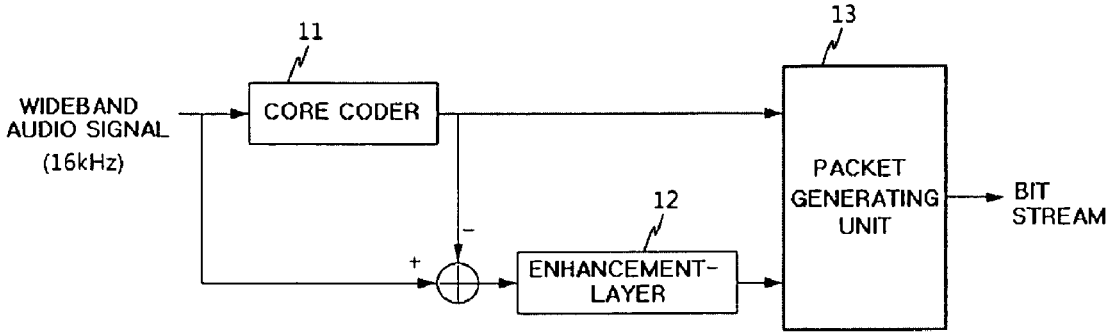
[FIG. 2]
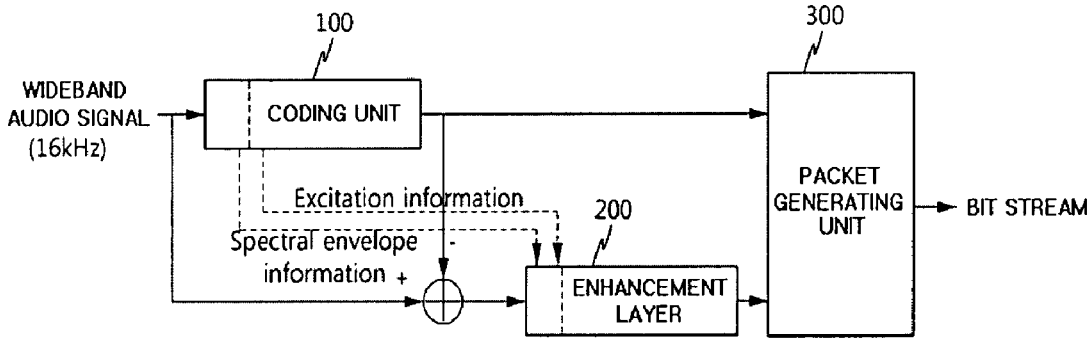

[FIG. 3]
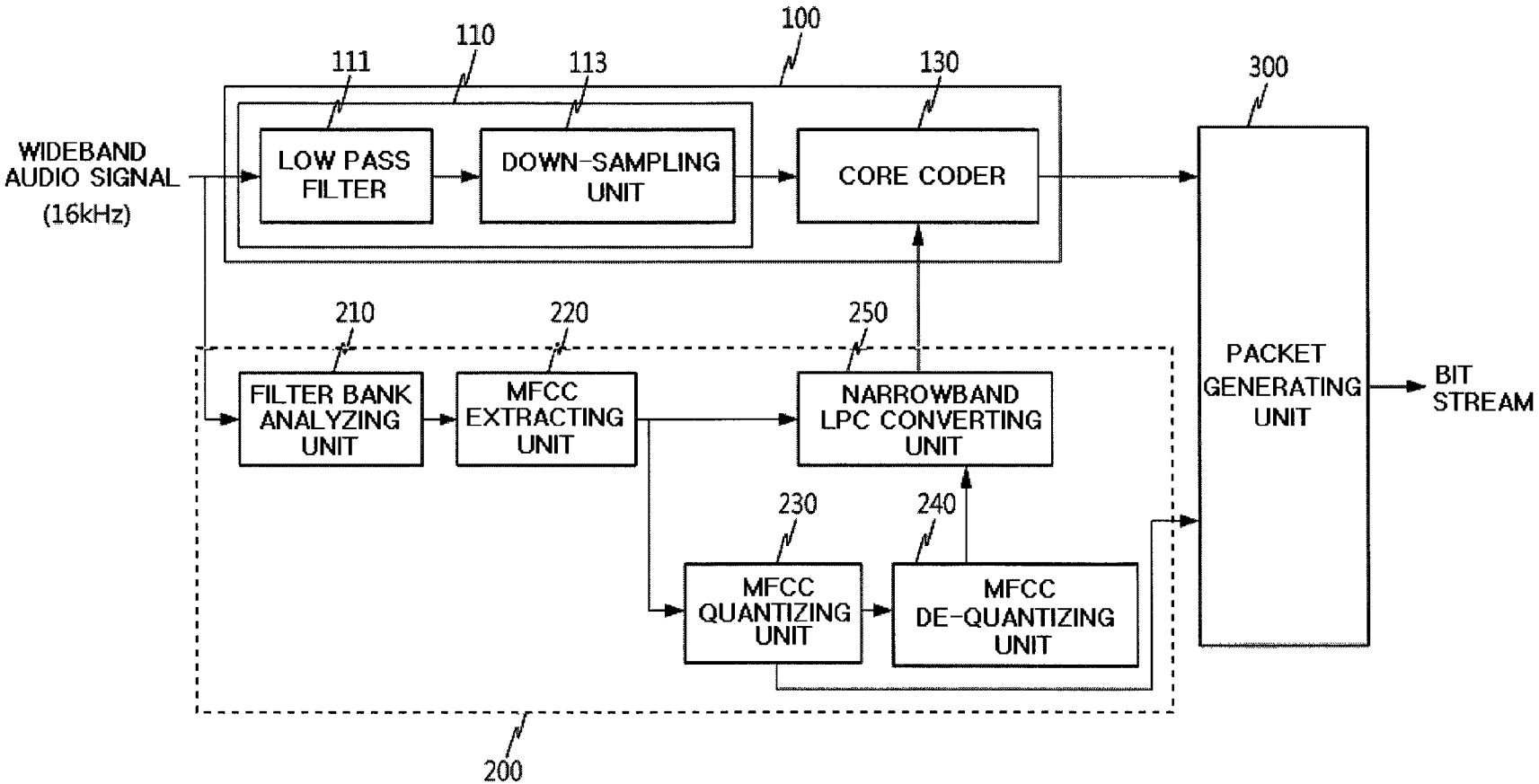

[FIG. 4]
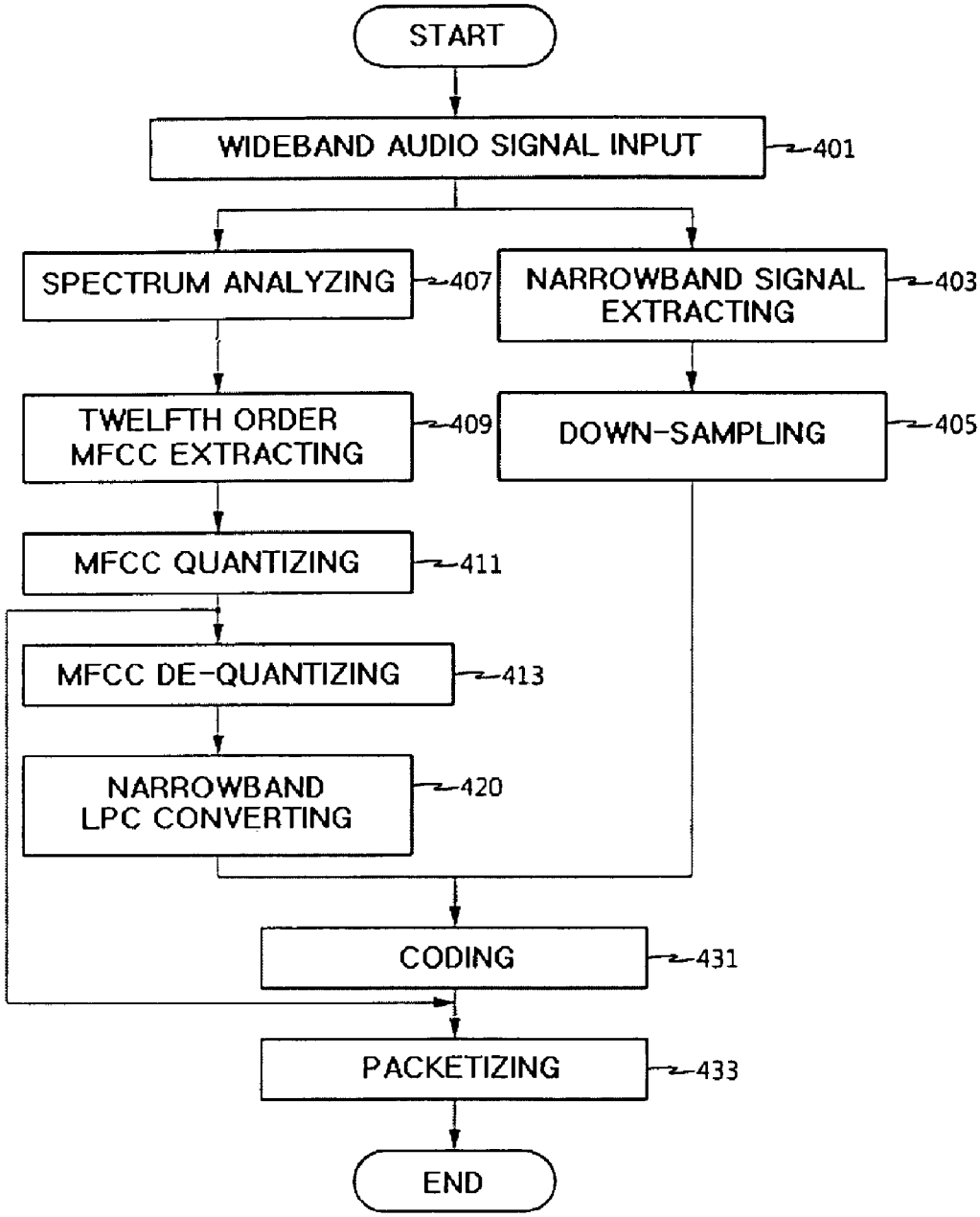

[FIG. 5]
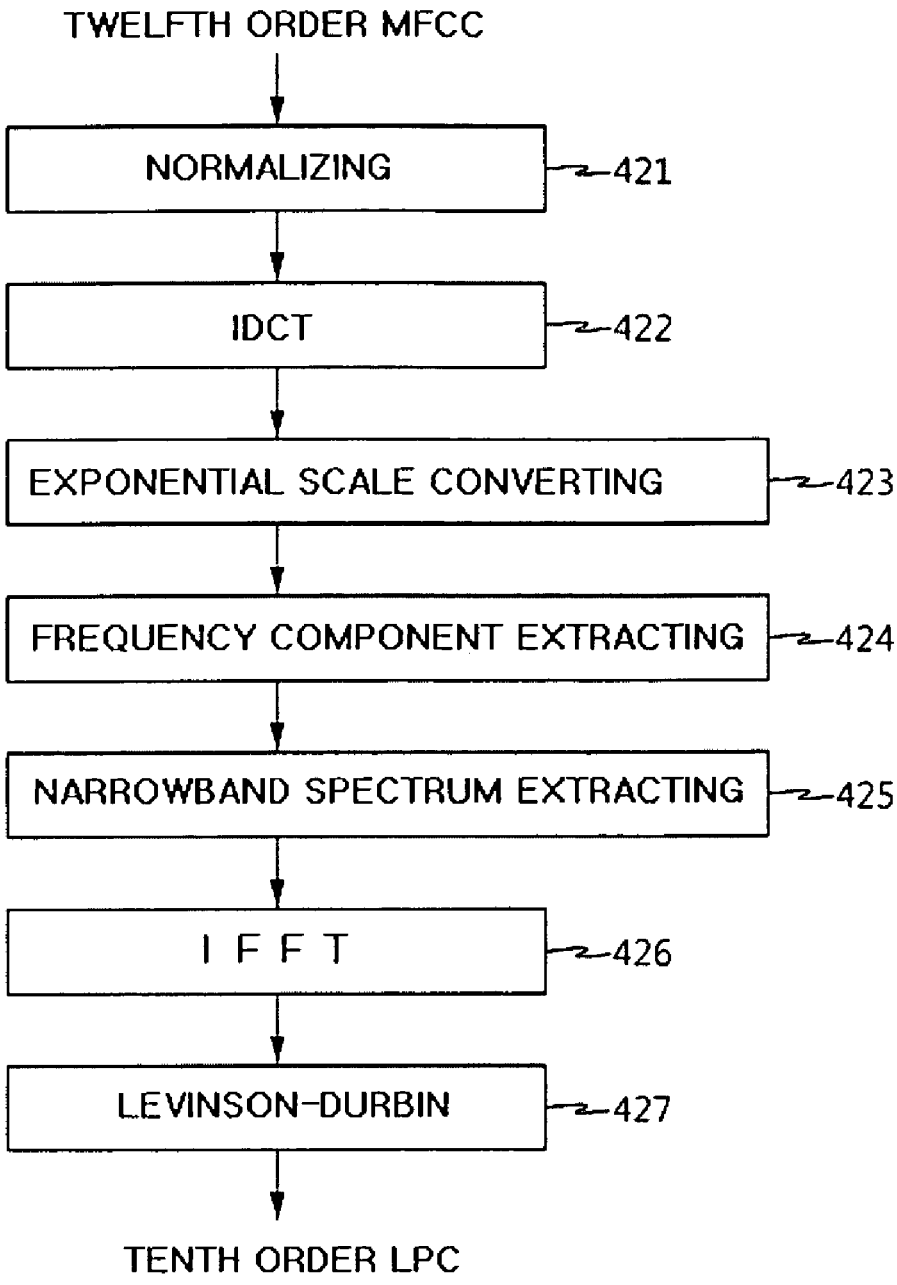

[FIG. 6]

| Parameter | 1st Subframe | 2nd Subframe | Total (10ms) |
|---|---|---|---|
| MFCC | 25 | | 25 |
| ACB index | 8 | 5 | 13 |
| Pitch parity | 1 | - | 1 |
| FCB index | 13 | 13 | 26 |
| FCB sign | 4 | 4 | 8 |
| Gain VQ | 7 | 7 | 14 |
| 2nd FCB index | 13 | 13 | 26 |
| 2nd FCB sign | 4 | 4 | 8 |
| 2nd FCB gain | 3 | 2 | 5 |
| FEC | - | 1 | 1 |
| Total | | | 127 |

[FIG. 7]
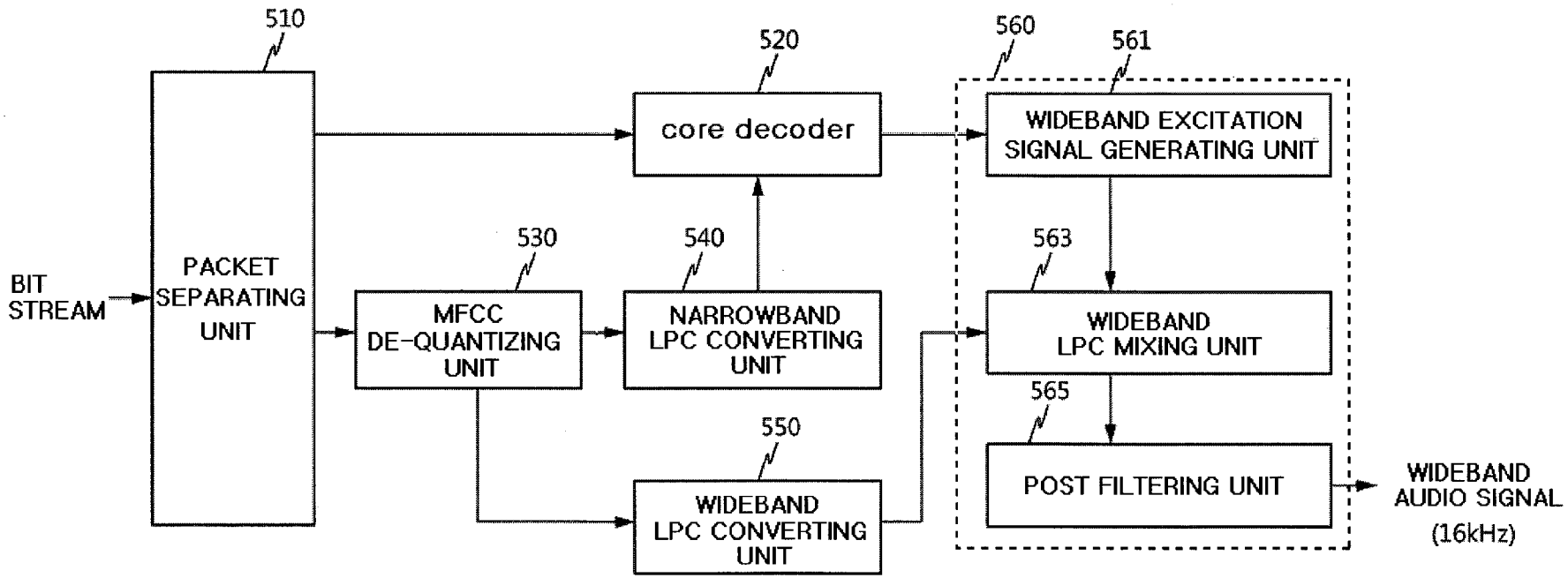

[FIG. 8]
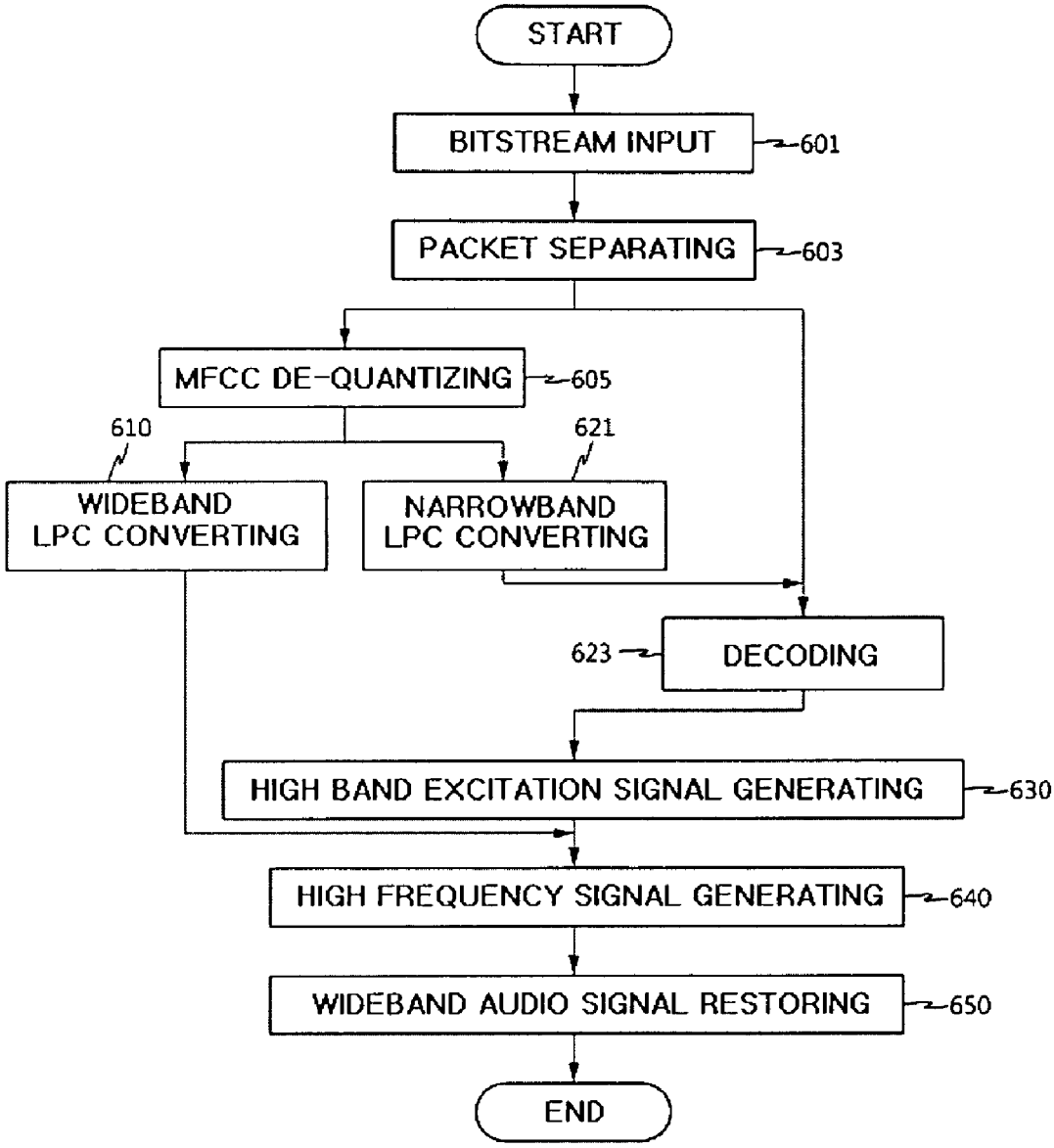

[FIG. 9]
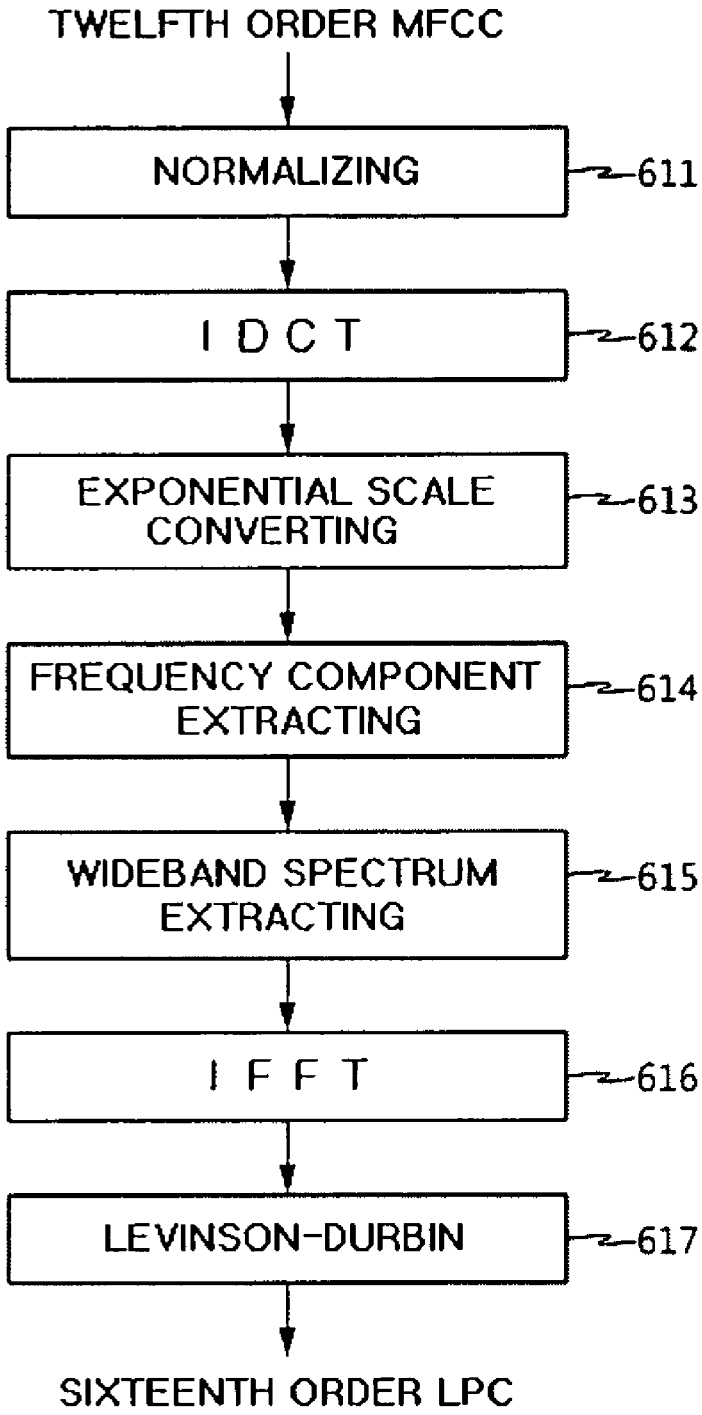

[FIG. 10]
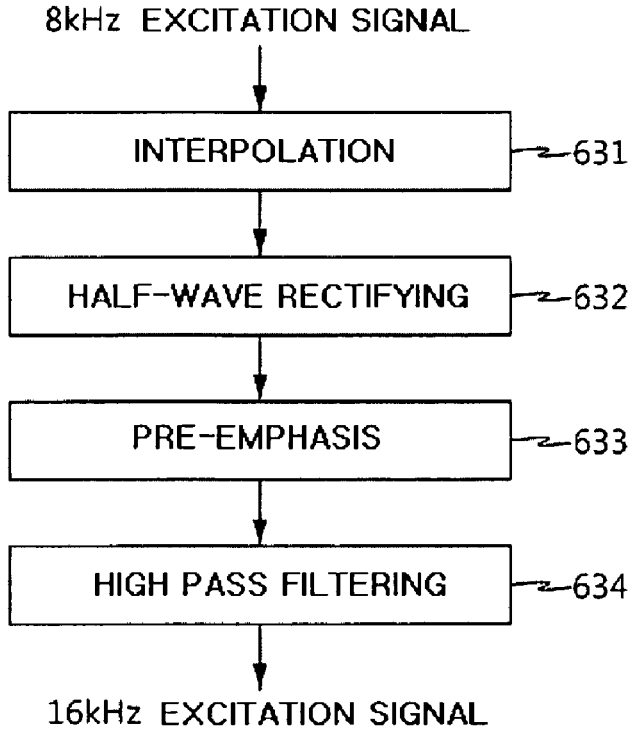
[FIG. 11]
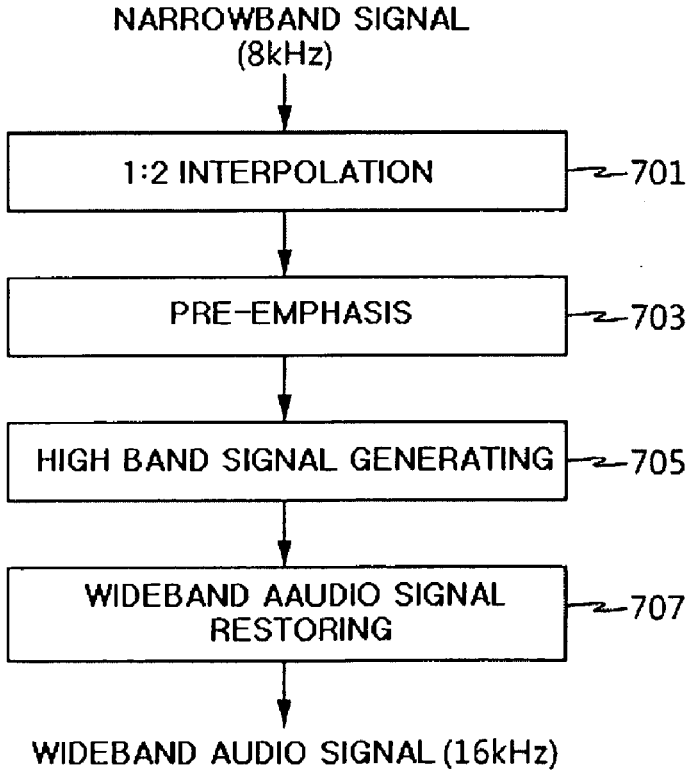

[FIG. 12]
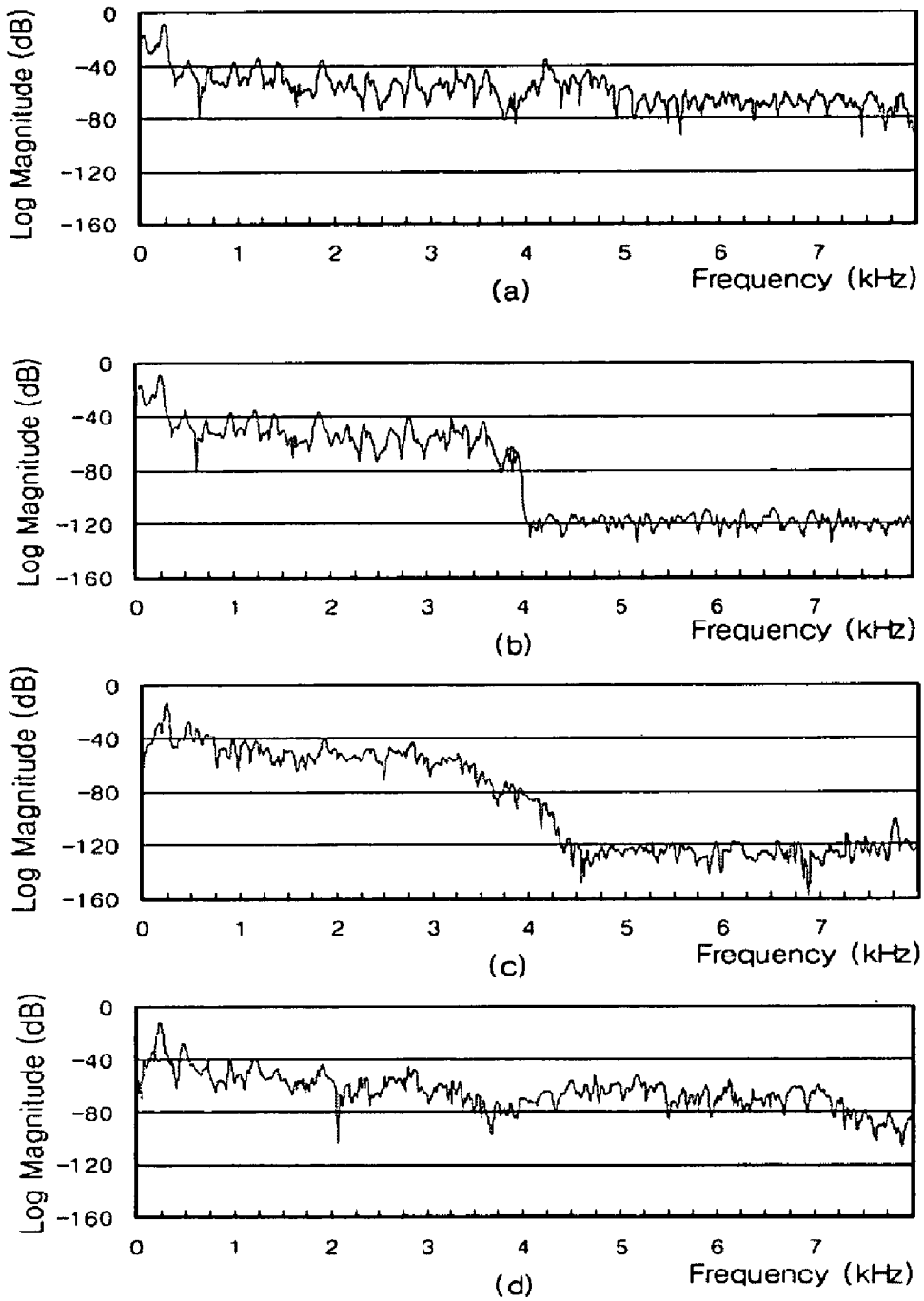

[FIG. 13]
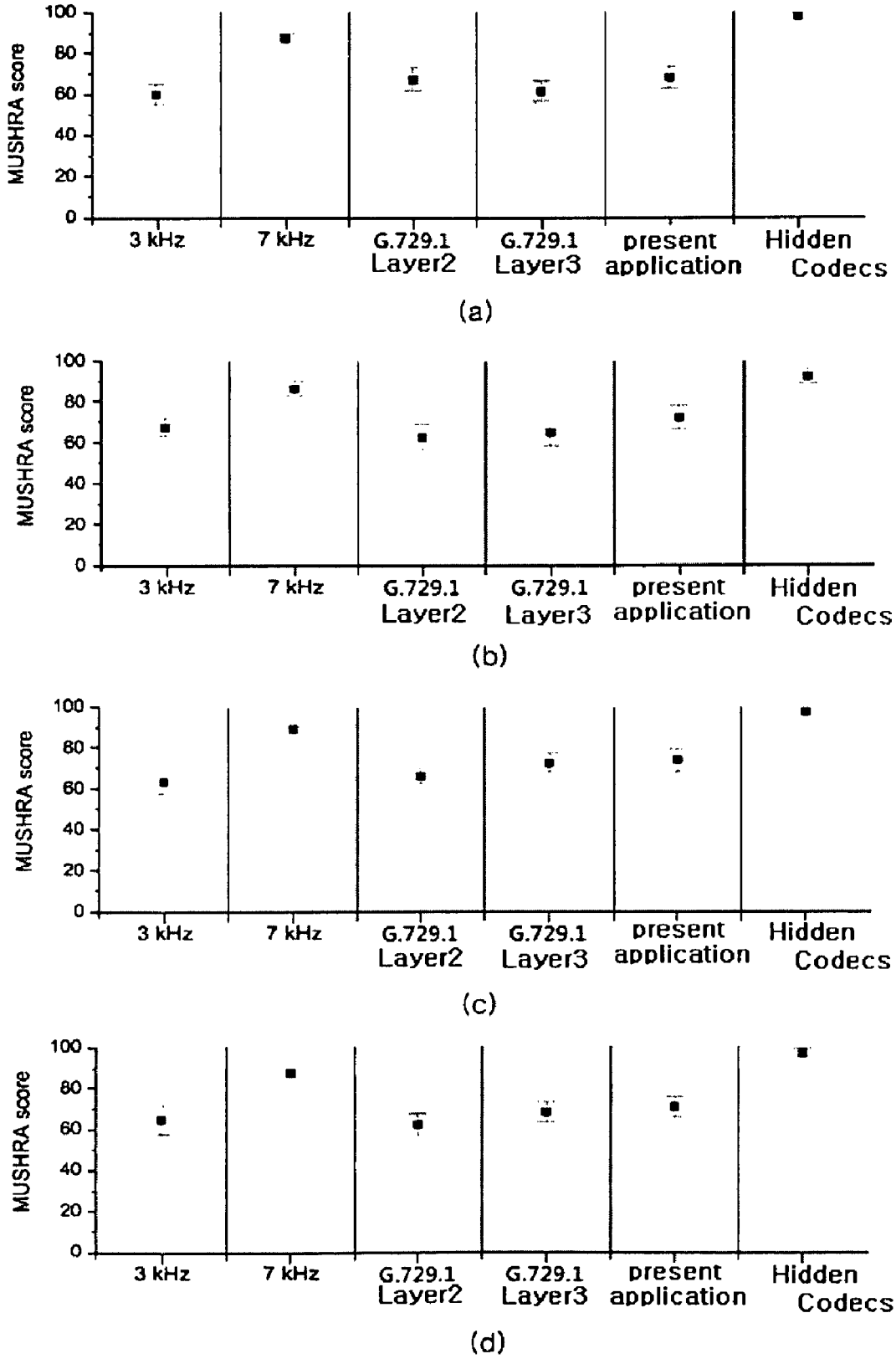

WIDEBAND AUDIO SIGNAL CODING/DECODING DEVICE AND METHOD

BACKGROUND OF THE INVENTION

1. Technical Field

The present invention relates to coding and decoding of an audio signal, and more specifically to a wideband audio signal coding and decoding apparatus and method capable of coding and decoding a wideband audio signal while maintaining a low bit rate.

2. Related Art

A voice coder, usually used for mobile communications services or VoIP (Voice over Internet Protocol) services, processes a narrowband signal whose bandwidth is less than 4 kHz.

For example, a VoIP voice coder processes a narrowband signal using a voice coder such as ITU-T G.729, ITU-T G.723.1, ITU-T G.728, or iLBC (Internet Low Bit-rate Codec), and then transmits the bitstream of the processed narrowband signal over an IP network.

The above-mentioned VoIP voice coder is appropriate for coding a narrowband voice signal, but not for a wideband signal that requires higher quality than a voice signal (for example, a music signal used for ring back tone services).

That is, the above-mentioned VoIP voice coder compresses an input signal into a signal having a low bit rate (for example, 5.3 to 15 kbit/s) under the assumption that the input signal has a bandwidth of substantially less than 3.4 kHz.

However, a high quality audio signal generally has a bandwidth of more than 4 kHz, and a coder should be able to process a wideband signal whose bandwidth is substantially more than 7 kHz in order to improve quality of an audio signal.

Moreover, a signal, which has been coded with a high bit rate, increases the packet size, and therefore, is prone to cause a packet loss in a transmission environment such as IP based networks, thus leading to lowering quality of the decoded audio. For example, a G.722 standard wideband coder, used for VoIP services, may code a 7 kHz wideband signal with a bit rate of 48, 56, or 64 kbit/s. However, the G.722 coder may give rise to quality degradation due to the high bit rate in a transmission environment such as IP based networks.

A standard for audio coders, such as MP3 (MPEG-1/2 Layer III) or AAC (Advanced Audio Coding) in by MPEG (Moving Picture Experts Group), etc., has been developed as a method for improving communication quality of audio signals. However, the above-mentioned audio coders have a disadvantage of being inappropriate for use in current mobile communications and VoIP service environments due to a high bit rate.

A wideband coder having a variable bit rate of a scalable or embedded method has been suggested to provide improved communication quality in an environment that requires a low bit rate such as mobile communications and IP network environments as a method for supplementing the disadvantage (A. Kataoka, S. Kurihara, S. Sasaki, and S. Hayashi, "A 16-kbit/s wideband speech codec scalable with G.729," Proc. Eurospeech, pp. 1491-1494, September 1997).

FIG. 1 is a conceptual view illustrating an operation principle of a wideband voice coder having a variable bit rate according to the prior art.

Referring to FIG. 1, a conventional embedded-type wideband voice coder having a variable bit rate includes a core coder 11, an enhancement layer 12, and a packet generating unit 13. The core coder 11 codes narrowband signals out of inputted audio signals. The enhancement layer 12 transmits additional bits depending on a network environment. The packet generating unit 13 packetizes signals outputted from the core coder 11 and the enhancement layer 12 to output a bit stream.

That is, the conventional embedded-type wideband coder codes narrow signals out of inputted audio signals with a low bit rate in the core coder 11. And, the conventional embedded-type wideband coder transmits only the signals coded in the core coder 11 to prevent the transmission loss if there are lots of traffics in a network, and transmits additional bits in the enhancement layer 12 to improve quality of audio signals if there are small traffics in the network.

However, since the enhancement layer 12 has been configured independently from the core coder 11 to increase bandwidth without considering the core coder 11 in the wideband voice coder having a variable bit rate, shown in FIG. 1, it is difficult to implement the enhancement layer 12 to have a low bit rate. Also, the enhancement layer 12 has been configured to process the same amount of information as that of the core coder 11 to substantially improve communication quality, which may increase the entire amount of information, thus causing the conventional coder to be inappropriate for transmission of wideband audio signals in mobile communications or IP based network environments.

A first aspect of the present invention provides a wideband audio signal coding/decoding device capable of coding wideband audio signal while maintaining a low bit rate.

A second aspect of the present invention provides a wideband audio signal coding/decoding method capable of coding a wideband audio signal while maintaining a low bit rate.

SUMMARY OF THE INVENTION

According to an exemplary embodiment of the present invention, there is provided a wideband audio signal coding device including: an enhancement layer that extracts a first spectrum parameter from an inputted wideband signal having a first bandwidth, quantizes the extracted first spectrum parameter, and converts the extracted first spectrum parameter into a second spectrum parameter; and a coding unit that extracts a narrowband signal from the inputted wideband signal and codes the narrowband signal based on the second spectrum parameter provided from the enhancement layer, wherein the narrowband signal has a second bandwidth smaller than the first bandwidth.

The first spectrum parameter may be an MFCC (Mel-Frequency Cepstral Coefficient).

The second spectrum parameter may be an LPC (Linear Prediction Coefficient).

The wideband audio signal coding device may further include a packet generating unit that packetizes the quantized first spectrum parameter and the coded narrowband signal having the second bandwidth to generate a bit stream.

The coding unit may include a narrowband signal extracting unit that low-pass-filters the wideband signal having the first bandwidth and down-samples the low-pass-filtered signal to extract the narrowband signal having the second bandwidth, and a core coder that codes the narrowband signal having the second bandwidth based on the second spectrum parameter.

The enhancement layer may normalize and apply an inverse discrete cosine transform (IDCT) to the extracted first spectrum parameter, convert the result in an exponential scale to extract a frequency component, extract a narrowband spectrum having the second bandwidth from the extracted frequency component, apply an inverse fast Fourier transform (IFFT) to the extracted narrowband spectrum, and convert the IFFT result into the second spectrum parameter using a Levinson-Durbin algorithm.

According to an exemplary embodiment of the present invention, there is provided a wideband audio signal decoding device including: a first parameter converting unit that converts a first spectrum parameter into a second spectrum parameter having a first bandwidth; a second parameter converting unit that converts the first spectrum parameter into a second spectrum parameter having a second bandwidth; a core decoder that decodes a coded bit stream to a signal having the second bandwidth based on the second spectrum parameter having the second bandwidth to generate an excitation signal having the second bandwidth; and a high frequency generating unit that restores a wideband signal having the first bandwidth based on the second spectrum parameter having the first bandwidth and the excitation signal having the second bandwidth.

The wideband audio signal coding and decoding device may further include: a packet separating unit that separates a coded first spectrum parameter and the coded bit stream from an inputted bit stream; and a de-quantizing unit that de-quantizes the coded first spectrum parameter to convert into the first spectrum parameter.

The second spectrum parameter having the first bandwidth may be a first order LPC (Linear Prediction Coefficient) and the second spectrum parameter having the second bandwidth may be a second order LPC whose order is lower than that of the first order LPC.

The first parameter converting unit may normalize and apply an IDCT to the inputted first spectrum parameter, convert the result in an exponential scale to extract a frequency component, extract a spectrum having the first bandwidth from the extracted frequency component, apply an IFFT to the extracted spectrum, and convert the IFFT result into the second spectrum parameter having the first bandwidth using a Levinson-Durbin algorithm.

The high frequency generating unit may include a wideband excitation signal generating unit that converts an excitation signal having the second bandwidth provided from the core decoder into an excitation signal having a third bandwidth, a wideband parameter mixing unit that generates a high frequency signal having the third bandwidth using the excitation signal having the third bandwidth and the second spectrum parameter having the first bandwidth, and a post filtering unit that restores a wideband signal having the first bandwidth using the signal having the second bandwidth and the high frequency signal having the third bandwidth.

The wideband excitation signal generating unit may expand the excitation signal having the second bandwidth by interpolation, remove negative components from the interpolated excitation signal through half wave rectification, increase high frequency components through pre-emphasis, and convert the result into an excitation signal having the third bandwidth through a HPF (High Pass Filter).

The post filtering unit may expand the signal having the second bandwidth into a signal having the first bandwidth by interpolation, limit the size of a high frequency signal pre-emphasis, and restore a wideband signal having the first bandwidth using the high frequency signal having the third bandwidth and the signal expanded to have the first bandwidth by the interpolation, whose high frequency components have been limited by the pre-emphasis.

According to an exemplary embodiment of the present invention, there is provided a wideband audio signal coding method including: extracting a first spectrum parameter from an inputted wideband signal having a first bandwidth; quantizing the first spectrum parameter; quantizing the first spectrum parameter; converting the first spectrum parameter into a second spectrum parameter; and coding a narrowband signal having the second bandwidth, which is extracted from the wideband signal having the first bandwidth, based on the second spectrum parameter.

According to an exemplary embodiment of the present invention, there is provided a wideband audio signal decoding method including: converting an inputted first spectrum parameter into a second spectrum parameter having a first bandwidth; converting the inputted first spectrum parameter into a second spectrum parameter having a second bandwidth; decoding a coded bit stream to a signal having the second bandwidth based on the second spectrum parameter having the second bandwidth to generate an excitation signal having the second bandwidth; and restoring a wideband signal having the first bandwidth based on the second spectrum parameter having the first bandwidth and the excitation signal having the second bandwidth.

According to the above-mentioned wideband audio signal coding/decoding device and method, the enhancement layer of the coding device may extract the twelfth order MFCC from the inputted wideband audio signal, quantize the extracted twelfth order MFCC, and convert the extracted twelfth order MFCC into the tenth order LPC. The coding unit extracts the narrow signal from the inputted wideband audio signal and codes the extracted narrow signal based on the tenth order LPC provided from the enhancement layer.

Furthermore, the decoding device includes the narrowband LPC converting unit that converts the de-quantized twelfth order MFCC into the narrowband LPC, the wideband LPC converting unit that converts the twelfth MFCC into the wideband LPC, the core coder that decodes the coded bit stream into the narrowband signal based on the tenth order LPC to generate the excitation signal, and the high frequency generating unit that restores the wideband audio signal based on the wideband LPC and the narrowband excitation signal.

Accordingly, the wideband audio signal coding/decoding device and method may perform coding and decoding of a wideband audio signal while maintaining the low bit rate. Additionally, the wideband audio signal coding/decoding device and method may use the conventional LPC based voice coder as the core coder, and thus, easily expand the conventional narrowband voice coder and decoder into the wideband audio coding/decoding device, thereby transmitting high quality wideband audio signals even over an IP based network such as mobile communications network or VoIP network.

Furthermore, the wideband audio signal coding/decoding device and method according to the exemplary embodiment of the present invention may also be easily employed for coding and decoding of the audio signal whose bandwidth is more than 8 kHz.

BRIEF DESCRIPTION OF THE DRAWINGS

FIG. 1 is a conceptual view illustrating an operation principle of a wideband voice coder having a variable bit rate according to the prior art;

FIG. 2 is a conceptual view illustrating an operation of a wideband audio signal coding device according to an exemplary embodiment of the present invention;

FIG. 3 is a block diagram illustrating a construction of a wideband audio signal coding device according to an exemplary embodiment of the present invention;

FIG. 4 is a flow chart illustrating a wideband audio signal coding process according to an exemplary embodiment of the present invention;

FIG. 5 is a flowchart illustrating a detailed process of the narrowband LPC conversion shown in FIG. 4;

FIG. 6 is a view illustrating bit allocation to each parameter in a wideband audio signal coding device according to an exemplary embodiment of the present invention;

FIG. 7 is a block diagram illustrating a construction of a wideband audio signal decoding device according to an exemplary embodiment of the present invention;

FIG. 8 is a flowchart illustrating a wideband audio signal decoding process according to an exemplary embodiment of the present invention;

FIG. 9 is a flowchart illustrating a detailed process of the wideband LPC conversion shown in FIG. 8;

FIG. 10 is a flowchart illustrating a detailed process of the high band excitation signal generation shown in FIG. 8;

FIG. 11 is a flowchart illustrating a detailed process of the wideband audio signal restoration shown in FIG. 8;

FIG. 12 is a graph illustrating a comparison result in performance between a wideband audio signal coding device according to an exemplary embodiment of the present invention and the conventional coding device; and FIG. 13 is a graph illustrating a subjective performance evaluation result of a wideband audio signal coding device according to an exemplary embodiment of the present invention.

DESCRIPTION OF EXEMPLARY EMBODIMENT

In the following detailed description, only certain exemplary embodiments of the present invention have been shown and described, simply by way of illustration. As those skilled in the art would realize, the described embodiments may be modified in various different ways, all without departing from the spirit or scope of the present invention. This invention may, however, be embodied in many different forms and should not be construed as being limited to the embodiments set forth herein; rather, these embodiments are provided so that this disclosure will be thorough and complete, and will fully convey the concept of the invention to those of ordinary skill in the art. Like reference numerals in the drawings denote like elements.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The term "and/or" includes any and all combinations of one or more of the associated listed items.

When it is described that an element is "coupled" or "connected" to another element, the element may be directly coupled or directly connected to the other element or may be a third element therebetween. On the contrary, when it is described that an element is "directly coupled" or "directly connected" to another element, it means no third element is there between.

The terminology used herein is for the purpose of describing particular embodiments only and is not intended to be limited by the exemplified embodiments. As used herein, the singular forms "a," "an" and "the" are intended to include the plural forms as well, unless the context clearly indicates otherwise. It will be further understood that the terms "comprises" and/or "comprising" when used in this specification, specify the presence of stated features, integers, steps, operations, elements, and/or components, but do not preclude the presence or addition of one or more other features, integers, steps, operations, elements, components, and/or groups thereof. The preferred embodiments of the invention will now be described more fully with reference to the accompanying drawings. Like reference numerals in the drawings denote like elements, and thus their description will be omitted.

The preferred embodiments of the invention will now be described more fully with reference to the accompanying drawings.

It is assumed in a wideband audio signal coding/decoding device according to an exemplary embodiment of the present invention that G.729.1 layer 2 is used as a core coder and a core decoder.

FIG. 2 is a conceptual view illustrating an operation of a wideband audio signal decoding device according to an exemplary embodiment of the present invention.

Referring to FIG. 2, the wideband audio signal coding device according to the exemplary embodiment generally includes a coding unit 100, an enhancement layer 200, and a packet generating unit 300. Here, the enhancement layer 200 is configured to have a low bit rate using spectral envelope information and/or excitation information that may be shared between the coding unit 100 and the enhancement layer 200.

Specifically, the coding unit 100 uses the core coder (refer to '130' in FIG. 3) that represents and compresses spectrum information of an audio signal using a mel-frequency cepstral coefficient (hereinafter, referred to as 'MFCC') on behalf of a line spectrum pair (hereinafter, referred to as 'LSP') obtained by converting a linear prediction coefficient (LPC).

In a case where the LSP corresponding to a low frequency, which has little correlation between frequencies, is only transmitted, the enhancement layer 200 may not anticipate or restore necessary high frequency spectra. This is why the MFCC is used instead of the LSP. Therefore, at least sixteenth order LSP coefficient should be transmitted in order to decode a 16 kHz signal whose bandwidth is 8 kHz.

However, the MFCC may extract information on spectra corresponding from a low frequency to a high frequency from each coefficient. That is, it is possible to decode a high frequency spectrum from the twelfth order MFCC. A consequence is to be capable of implementing a coding device that may code a wideband audio signal while maintaining a low bit rate by transmitting the small numbers of bits required by quantizing the MFCC in the enhancement layer 200 instead of quantizing and transmitting the sixteenth order LSP.

In addition, the core coder used in the coding unit 100 codes a voice using the LPC, which has been converted from the MFCC acquired by analyzing the wideband signal, instead of directly using the LSP (Line Spectrum Pairs), and simultaneously, obtains high frequency spectrum information from the MFCC acquired by analyzing the wideband audio signal in the enhancement layer 200.

FIG. 3 is a block diagram illustrating a construction of a wideband audio signal coding device according to an exemplary embodiment of the present invention, wherein it describes an input of 16 kHz signal having 8 kHz bandwidth as a wideband audio signal, for example.

Referring to FIG. 3, the wideband audio signal coding device includes a coding unit 100, an enhancement layer 200, and a packet generating unit 300.

The coding unit 100 may include a narrowband signal extracting unit 110 and a core coder 130. The narrowband signal extracting unit 110 performs a pre-processing function to extract a signal to be inputted to the core coder 130 out of inputted wideband audio signals.

Specifically, the narrowband signal extracting unit 110 may include a low pass filter 111 and a down sampling unit 113. The low pass filter 111 performs low pass filtering on an inputted wideband audio signal to extract a narrowband signal with a bandwidth of 4 kHz. The down sampling unit 113 down-samples the narrowband signal with 4 kHz bandwidth transmitted from the low pass filter 111 to convert into an 8 kHz signal. The 8 kHz signal is divided into a segment unit, each of which has a size of 10 to 20 ms that corresponds to a processing unit in a general core coder 130 (for example, G.729.1 layer 2), and the divided segments are provided as an input to the core coder 130.

The core coder 130 receives the LPC, which has been converted from the MFCC, from a narrowband LPC converting unit 250 of the enhancement layer 200, codes the narrowband signal using the LPC, and provides a resultant bit stream to the packet generating unit 300. Since the LPC used in the core coder 130 has been obtained by converting the MFCC, the core coder 130 does not separately calculate or store the LPC.

The enhancement layer 200 extracts the twelfth order MFCC from the 16 kHz wideband audio signal and converts the extracted twelfth order MFCC to the narrowband LPC used in the core coder 130. For this purpose, the enhancement layer 200 may include a filter bank analyzing unit 210, an MFCC extracting unit 220, an MFCC quantizing unit 230, an MFCC de-quantizing unit 240, and a narrowband LPC converting unit 250.

The filter bank analyzing unit 210 performs an FFT (Fast Fourier Transform) on 16 kHz wideband audio signal whose band width is 8 kHz with a size of 512 points to analyze the spectra of the inputted wideband audio signal, and then provides the spectral envelop information of the inputted wideband signal to the MFCC extracting unit 220. Generally, an FFT is carried out on a voice of 4 kHz bandwidth with a size of 256 points. However, the present invention extracts the MFCC from a wideband audio signal having a bandwidth of 8 kHz, and therefore, performs an FFT with a size of 512 points.

The MFCC extracting unit 220 extracts the twelfth order MFCC from the signal provided from the filter bank analyzing unit 210 and provides the extracted twelfth order MFCC to the MFCC quantizing unit 230. The MFCC quantizing unit 230 quantizes the twelfth order MFCC provided from the MFCC extracting unit 220 into 25 bits and provides the quantized result to the MFCC de-quantizing unit 240 and the packet generating unit 300.

The MFCC 240 de-quantizes the quantized twelfth order MFCC signal provided from the MFCC quantizing unit 230 to restore the twelfth order MFCC and provides the restored twelfth order MFCC to the narrowband LPC converting unit 250.

The narrowband LPC converting unit 250 converts the restored twelfth order MFCC provided from the MFCC de-quantizing unit 240 into the LPC corresponding to a bandwidth of 4 kHz, and provides the converted LPC to the core coder 130.

The packet generating unit 300 packetizes the coded bit stream provided from the core coder 130 and 25 bits provided from the MFCC quantizing unit 230 to generate a bit stream.

The core coder 130 of the wideband audio signal coding device shown in FIG. 3 according to the exemplary embodiment of the present invention, may employ any LPC-based voice coder such as G.729 and iLBC widely used in a current VoIP service, and IS-127(EVRC: Enhanced Variable Rate Codec) used in a CDMA environment.

For example, in a case where G.729.1 layer 2 (ITU-T Recommendation G.729.1, An 8-32 kbit/s scalable wideband coder bit stream interoperable with G.729, 2006) is used as the core coder 130, the LSP used in the G.729.1 layer 2 is replaced by the MFCC, and this enables the G.729.1 layer 2 to be expanded as a wideband audio signal coder while maintaining a low bit rate by adding only seven bits to the G.729.1 layer 2. That is, the wideband audio signal coding device, in which the G.729.1 layer 2 operating in 12 kbit/s is used as the core coder 130, operates in 12.7 kbit/s, thus making it possible to code a wideband audio signal only with the increment of 0.7 kbit/s.

Furthermore, in a case where iLBC (IETF RFC 3951, Internet Low Bit Rate Codec specification, December 2004.) is used as the core coder, the addition of only 5 bits to the iLBC enables the conventional narrowband voice coder to be implemented as the wideband audio signal coding device while maintaining a low bit rate.

FIG. 4 is a flow chart illustrating a wideband audio signal coding process according to an exemplary embodiment of the present invention.

Referring to FIG. 4, if a 16 kHz signal having a bandwidth of 8 kHz is inputted (step 401), the low pass filter 111 performs low pass filtering on the inputted wideband audio signal to extract a narrowband signal having a bandwidth of 4 kHz (step 403), and the down sampling unit 113 down-samples the signal having 4 kHz bandwidth provided from the low pass filter 111 to convert into an 8 kHz signal (step 405).

At the same time, the filter bank analyzing unit 210 performs an FFT (Fast Fourier Transform) on the inputted 16 kHz wideband audio signal with a size of 512 points to analyze the inputted wideband audio signal (step 407).

Thereafter, the MFCC extracting unit 220 extracts the twelfth order MFCC from spectrum information provided from the filter bank analyzing unit 210 (step 409) and the MFCC quantizing unit 230 quantizes the extracted twelfth order MFCC into 25 bits (step 411).

The MFCC de-quantizing unit 240 de-quantizes the quantized twelfth order MFCC signal provided from the MFCC quantizing unit 230 to restore the twelfth order MFCC (step 413) and the narrowband LPC converting unit 250 converts the restored twelfth order MFCC into an LPC corresponding to a bandwidth of 4 kHz (step 420).

The core coder 130 codes the narrowband signal down-sampled in the step 405 using the LPC converted in the step 420 (step 431).

Thereafter, the packet generating unit 300 packetizes the bit stream coded in the step 431 and the 25-bit twelfth order MFCC quantized in the step 411 to output a bit stream (step 433).

FIG. 5 is a flowchart illustrating a detailed process of the narrowband LPC conversion step (step 420) shown in FIG. 4, which may be carried out by the narrowband LPC converting unit 250 shown in FIG. 3.

Referring to FIG. 5, the MFCC de-quantized in the step 413 of FIG. 4 is normalized according to the equation 1 (step 421)

$$mfcc'(k) = \frac{MFCC(k)}{MFCC_{norm}},\ k = 1, \ldots, 12 \qquad \text{[Equation 1]}$$

In Equation 1, MFCC(k) refers to the k-th coefficient out of the twelfth order MFCC extracted in the step 409 of FIG. 4, and $MFCC_{norm}$ is represented according to Equation 2.

$$MFCC_{norm} = \sqrt{\frac{2}{NFB}} \quad \text{[Equation 2]}$$

In Equation 2, NFB refers to the number of filter banks used for extraction of the MFCC, which has been set to '23' in the wideband audio signal coding device according to the exemplary embodiment of the present invention.

The MFCC (that is, mfcc'(k)) normalized according to Equation 1 is subjected to an inverse discrete cosine transform (hereinafter, referred to as 'IDCT') according to Equation 3 (step 422).

$$mfcc'_{IDCT}[fb] = \sum_{k=1}^{12} C(k)mfcc'(k)\cos\left(\frac{\pi(fb+0.5)k}{NFB}\right), \quad \text{[Equation 3]}$$

$$fb = 0, \ldots, NFB-1$$

In the equation 3, $mfcc'_{IDCT}$[fb] refers to the size of the fb-th filter bank obtained by performing the IDCT on the mfcc'. And, C(k) is 2NFB and, unless k is 0, C(k) is NFB.

A log-scale transform is performed on frequency components for considering human hearing properties in the twelfth order MFCC extraction process (step 409) shown in FIG. 4. Accordingly, an exponential-scale transform, which corresponds to the reverse process of the log-scale transform, is performed on $mfcc'_{IDCT}$[fb] obtained from Equation 3 according to Equation 4 (step 423).

$$dfmag[fb]=e^{mfcc'_{IDCT}[fb]},\ k=0, \ldots, NFB-1 \quad \text{[Equation 4]}$$

Thereafter, frequency components are found using the size of each filter bank obtained through the above processes.

Firstly, 256 frequency components are acquired using Equation 5 through a reverse process of the process of applying a triangular weight to the mel-frequency (step 424).

$$dftsig[i] = dftmag'[fb] \times \text{weight}\ [i] + dftmag'[fb] \times (1 - \text{weight}\ [i]),\ i = 0, \ldots, 255 \quad \text{[Equation 5]}$$

In Equation 5, dftmaq'[fb] refers to the size of the normalized filter bank, weight[i] to a mel-frequency transformed, used weight, fb to the index of the filter bank, and i to the index of a frequency component.

Next, a narrowband spectrum is extracted from the frequency components obtained in the step 424 using Equation 6 (step 425).

$$\text{real}[i]=\text{real}[256-i]=dftsig[i]\times deemp[i],\ i=0, \ldots, 128 \quad \text{[Equation 6]}$$

In Equation 6, deemp[i] refers to a de-emphasis filter which may be obtained according to Equation 7 in the frequency domain.

$$deemp[i] = \left(1.81 - 1.8\cos\left(\frac{2\pi i}{256}\right)\right)^{-2},\ i = 0, \ldots, 128 \quad \text{[Equation 7]}$$

deemp[i] acquires the tenth order autocorrelation coefficient through 256-point IFFT (Inverse Fast Fourier Transform) (step 426).

That is, 128 frequency samples, which correspond to a narrowband, are acquired from 256 frequency samples, which correspond to a wideband, to obtain the autocorrelation coefficient corresponding to a low frequency band up to 8 kHz. And, this is designed symmetrically with respect to the 128th frequency axis. De-emphasis is done to perform a reverse operation of the pre-emphasis used upon extraction of the MFCC.

Then, the tenth order LPC is obtained from the tenth order autocorrelation coefficient through the Levinson-Durbin algorithm (step 427).

FIG. 6 is a view illustrating bit allocation to each parameter in a wideband audio signal coding device according to an exemplary embodiment of the present invention.

Referring to FIG. 6, 25 bits are allocated to the MFCC, and bit allocation to the other parameters than the MFCC is identical to that of the G.729.1 layer 2.

The conventional G.729.1 layer 2 has allocated 18 bits for quantization of LSF (Line Spectral Frequencies) parameter with a bit rate of 12 kbit/s. Accordingly, 7 bits are further added to each and every frame compared to the G.729.1 layer 2 in the wideband audio signal coding device according to the exemplary embodiment of the present invention, and this causes the bit rate to be 12.7 kbit/s.

That is, the wideband audio signal coding device according to the exemplary embodiment of the present invention may code a wideband audio signal only by the increment of bit rate of 0.7 kbit/s in comparison to the G.729.1 layer 2.

FIG. 7 is a block diagram illustrating a construction of a wideband audio signal decoding device according to an exemplary embodiment of the present invention.

Referring to FIG. 7, the wideband audio signal decoding device according to the exemplary embodiment of the present invention, includes a packet separating unit 510, a core decoder 520, an MFCC de-quantizing unit 530, a narrowband LPC converting unit 540, a wideband LPC converting unit 550, and a high frequency generating unit 560.

The packet separating unit 510 separates the bit stream transmitted from the wideband audio signal coding device shown in FIG. 3 into a bit stream to be processed in the core decoder 520 and a twelfth order MFCC quantized in 25 bits.

The core decoder 520 decodes the bit stream provided from the packet separating unit 510 into a signal with a bandwidth of 4 kHz using the narrowband LPC provided from the narrowband LPC converting unit 540, and provides a narrowband excitation signal to a wideband excitation signal generating unit 561 of the high frequency generating unit 560.

The MFCC de-quantizing unit 530 de-quantizes the quantized twelfth order MFCC provided from the packet separating unit 510 to restore the twelfth order MFCC.

The narrowband LPC converting unit 540 converts the twelfth order MFCC provided from the MFCC de-quantizing unit 530 into a narrowband LPC and provides the narrowband LPC to the core decoder 520. The narrowband LPC converting unit 540 has the same function as that of the narrowband LPC converting unit 250 shown in FIG. 3, and thus, the detailed descriptions will be omitted to avoid repetition of descriptions. The wideband LPC converting unit 550 converts the twelfth order MFCC provided from the MFCC de-quantizing unit 530 into a wideband LPC and provides the wideband LPC to a wideband LPC mixing unit 563 of the high frequency generating unit 560.

The high frequency generating unit 560, which may include a wideband excitation signal generating unit 561, a wideband LPC mixing unit 563, and a post filtering unit 565, restores the wideband audio signal using the provided narrowband excitation signal and the wideband LPC.

The wideband excitation signal generating unit 561 performs a 1 to 2 interpolating process on the narrowband excitation signal (that is, less than 8 kHz) provided from the core decoder 520 to generate a high band excitation signal (that is, 8 to 16 kHz).

The wideband LPC mixing unit 563 generates a high frequency signal whose frequency ranges from 8 kHz to 16 kHz (that is, bandwidth of 4 to 8 kHz) using the high band excitation signal and the wideband LPC provided from the wideband excitation signal generating unit 561.

The post filtering unit 565 processes the high frequency signal provided from the wideband LPC mixing unit 563 to restore and output a psychoacoustically smooth wideband audio signal.

FIG. 8 is a flowchart illustrating a wideband audio signal decoding process according to an exemplary embodiment of the present invention.

Referring to FIG. 8, if a bit stream is inputted to the wideband audio signal decoding device (step 601), the packet separating unit 510 divides the inputted bit stream into a bit stream to be processed in the core decoder 520 and twelfth order MFCC quantized in 25 bits (step 603).

Then, the MFCC de-quantizing unit 530 de-quantizes the quantized twelfth order MFCC into the twelfth order MFCC (step 605). The wideband LPC converting unit 550 converts the de-quantized twelfth order MFCC into a wideband LPC (step 610), and simultaneously, the narrowband LPC converting unit 540 converts the de-quantized twelfth order MFCC into a narrowband LPC (step 621).

The core decoder 520 decodes the bit stream separated by the packet separating unit 510 in the step 603 to a narrowband audio signal based on the narrowband LPC converted by the narrowband LPC converting unit 540 in the step 621 to generate a narrowband excitation signal (step 623).

Thereafter, the wideband excitation signal generating unit 561 performs a 1 to 2 interpolation process on the narrowband excitation signal generated in the step 623 to generate a high band excitation signal (step 630).

The wideband LPC mixing unit 563 generates a high frequency signal using the high band excitation signal and the wideband LPC converted in the step 610 (step 640).

Then, the post filtering unit 565 restores the high frequency signal into the wideband audio signal and outputs the wideband audio signal (step 650).

FIG. 9 is a flowchart illustrating a detailed process of the wideband LPC conversion step (step 610) shown in FIG. 8, which may be performed by the wideband LPC converting unit 550.

The steps 611 to 614 shown in FIG. 9 are identical to the steps 421 to 424 shown in FIG. 5, and thus, the detailed descriptions will be omitted to avoid repetitive descriptions.

Wideband spectra are extracted from the frequency components obtained in the step 614 according to Equation 8 (step 615).

$$\text{real}[i]=\text{real}\,[512-i]=dftsig[i]\times deemp[il2],\ i=0,\ldots,256 \qquad \text{[Equation 8]}$$

The wideband spectrum is symmetrical with respect to the 256th frequency component to acquire a wideband autocorrelation coefficient. The deemp[i] in the equation 8 may be acquired from the equation 7.

Thereafter, a 16th order autocorrelation coefficient is acquired by performing an IFFT with a size of 512 points (step 616), and a 16th order LPC is acquired through the Levinson-Durbin algorithm (step 617).

FIG. 10 is a flowchart illustrating a detailed process of the high band excitation signal generation step shown in FIG. 8, which may be performed by the wideband excitation signal generating unit 561 shown in FIG. 7.

FIG. 10 illustrates a process of expanding the excitation signal used in the core decoder 520 to generate high frequency components using the 16th order LPC acquired through the wideband LPC conversion.

Firstly, the narrowband excitation signal generated in the core decoder 520 is expanded through an interpolation process as represented in Equation 9 (step 631).

$$e_{16k}(i)=\begin{cases} e_{8k}(i/2), & i=0,2,\ldots,2N-2 \\ 0, & i=1,3,\ldots,2N-1 \end{cases} \qquad \text{[Equation 9]}$$

In Equation 9, N refers to the number of samples (for example, 80) used to generate one frame in the core coder and the core decoder 520, $e_{8k}(i)$ refers to the i-th sample of the excitation signal generated in the core decoder 520, and $e_{16k}(i)$ refers to the i-th sample of the high band excitation signal generated for reproduction of the wideband audio signal.

Thereafter, negative components are removed from the excitation signal interpolated through a half-wave rectification process according to Equation 10 (step 632).

$$e_{r,16k}(i)=\begin{cases} e_{16k}(i), & \text{if } e_{16k}(i)>0 \\ 0, & \text{otherwise} \end{cases},\ i=0,\ldots,2N-1 \qquad \text{[Equation 10]}$$

where, $e_{r,16k}(i)$ refers to the i-th sample of the half-wave rectified excitation signal.

Next, a pre-emphasis process is carried out using the equation 11 to increase the high frequency components of the interpolated excitation signal (step 633).

$$e_{p,16k}(i)=e_{r,16k}(i)-\alpha e_{r,16k}(i),\ i=0,\ldots,2N-1 \qquad \text{[Equation 11]}$$

In Equation 11, $\alpha$ refers to a pre-emphasis coefficient, and this may be set, for example, as 0.9.

Subsequently, the excitation signal whose high frequency components have been increased in the step 633 is high pass filtered according to Equation 12 to generate a high band excitation signal.

$$e_{h,16k}(i)=e_{p,16k}(i)*h_{hpf}(i) \qquad \text{[Equation 12]}$$

Equation 12 means performing a convolution of the excitation signal $e_{p,16k}(i)$ acquired in the step 633 and the high pass filter $h_{hpf}(i)$.

FIG. 11 is a flowchart illustrating a detailed process of the wideband audio signal restoration shown in FIG. 8, which may be performed by the post filtering unit 565 shown in FIG. 7.

Firstly, the narrowband signal (that is, 8 kHz) restored in the core decoder 520 is expanded into a 16 kHz signal using a 1 to 2 interpolating process in order to reproduce the wideband audio signal using the high frequency signal provided from the wideband LPC mixing unit 563 and the signal restored in the core decoder 520, and the expanded 16 kHz signal is referred to as $s_{i,8k}(i)$ (step 701), where i refers to a sample number.

Thereafter, $s_{i,8k}(i)$ is subjected a pre-emphasis process using the equation 13 to prevent the high frequency spectra of the 16 kHz expanded voice from increasing excessively (step 703).

$$s_{p,8k}(i)=e_{i,8k}(i)-\beta s_{i,8k}(i-1) \quad \text{[Equation 13]}$$

In Equation 13, β is a pre-emphasis coefficient and this may be set as 0.2.

Next, such a high band signal as represented in Equation 14 is generated using the wideband LPC and the excitation signal acquired in Equation 12 (step 705).

$$s_{p,16k}(i)=e_{h,16k}(i)*h_{LPC}(i) \quad \text{[Equation 14]}$$

In Equation 14, $h_{LPC}(i)$ refers to a filter corresponding to the LPC, and $s_{p,16k}(i)$ refers to a high band (that is, 8 to 16 kHz) audio signal.

Thereafter, the wideband audio signal is restored using Equation 15 (step 707).

$$s_{16k}(i)=as_{p,16k}(i)+bs_{p,8k}(i+D),\ i=0,\ldots,159 \quad \text{[Equation 15]}$$

In Equation 15, 'a' and 'b' refer to a weight of the high band signal and a weight of the narrowband signal restored from the high band signal and the narrowband signal, respectively, with respect to the wideband audio signal, wherein the sound quality of the restored wideband audio signal changes depending on 'a' and 'b'. In the exemplary embodiment of the present invention, 'a' is set as 0.5 and 'b' is set as 1.2 based on values resulting from repetitive experiments. And, 'D' refers to a delay time required to convert the narrowband signal into the wideband audio signal, and this is set as 48 samples in the exemplary embodiment of the present invention.

FIG. 12 is a graph illustrating a comparison result in performance between a wideband audio signal coding device according to an exemplary embodiment of the present invention and the conventional coding device.

No. 70 track out of SQAM (Sound Quality Assessment Material) provided from EBU (European Broadcasting Union) was used in FIG. 12 to compare the coding device according to the exemplary embodiment of the present invention and the conventional coding device.

Because SQAM is a stereo audio signal sampled in 44.1 kHz, a mono signal sampled in 16 kHz was used to acquire a wideband signal necessary for performance experiments of the wideband audio signal coding device according to the exemplary embodiment of the present invention. Accordingly, the wideband signal has a bandwidth of 8 kHz.

The wideband audio signal coding device and the wideband audio signal decoding device shown in FIGS. 3 and 7 according to the exemplary embodiments of the present invention may be implemented as a single hardware device or as each separate chip for each function. For instance, the wideband audio signal coding device and the wideband audio signal decoding device according to the exemplary embodiments of the present invention may be implemented as an ASIC or a programmable chip such as an ARM or DSP chip.

Additionally, the wideband audio signal coding device and the wideband audio signal decoding device according to the exemplary embodiments of the present invention may be implemented as software executable by a predetermined processor.

FIG. 12A illustrates frequency properties of a wideband audio signal used as an input of a wideband audio signal coding device according to an exemplary embodiment of the present invention.

FIG. 12B illustrates frequency properties of a narrowband signal from which high frequency components of 4 to 8 kHz have been removed through the low pass filter 111 shown in FIG. 3.

The core coder 130 shown in FIG. 3 receives and compresses the narrowband signal shown in FIG. 12B.

FIG. 12C illustrates a signal restored through the core decoder 520 shown in FIG. 7. That is, it can be seen from FIG. 12C that the high frequency components (that is, 4 to 8 kHz frequency band) are not removed only by the core coder.

FIG. 12D illustrates frequency properties of the wideband audio signal restored from the wideband audio signal decoding device shown in FIG. 7. It can be seen from FIG. 12D that the signal restored in the core decoder 520 has the intensity of less than −80 dB in the high frequency components of 4 to 8 kHz as shown in FIG. 12C, however, the signal restored through the wideband audio signal decoding device according to the exemplary embodiments of the present invention is similar to the input signal shown in FIG. 12A.

FIG. 13 is a graph illustrating a subjective performance evaluation result of a wideband audio signal coding device according to an exemplary embodiment of the present invention.

In FIG. 13, a MUSHRA (Multiple Stimuli with Hidden Reference and Anchor) test, which is a subjective evaluation standard, has been made for comparison in quality between the wideband audio signal coding device according to the exemplary embodiment of the present invention and G.729.1 layer 3 which has been expanded from G.729.1 layer 2.

The MUSHRA test evaluation method has been defined in the ITU-R BS.1534-1 (ITU-R Recommendation BS.1534, Method for the subjective assessment of intermediate quality level of coding systems, January 2003).

Listeners randomly heard a original sound, a 3 kHz low pass filtered audio signal, a 7 kHz low pass filtered audio signal, and an audio signal processed by a coder desired to be under the quality measurement, evaluated the hearing results on the basis of coding unit 100 points, and determined the quality of the audio signal based on the average of the evaluation results from the whole listeners and 95% reliability.

With respect to music categories including a pop song (FIG. 13A), a classic (FIG. 13B), a hip hop (FIG. 13C), and a rock (FIG. 13D), five songs for each music category, i.e. total 20 songs were used as the sound sources for the MUSHRA test.

Each sound source used for the test was a mono audio signal sampled in 16 kHz which plays back 20 seconds, and the MUSHRA test was carried out on seven men and women in their twenties without hearing impairments.

FIGS. 13A to 13D show quality evaluation results regarding each music category. It can be seen from FIGS. 13A to 13D that the wideband audio signal coding device according to the exemplary embodiments, which has a bit rate of 12.7 kbit/s, provides good quality in the whole music categories compared to the G.729.1 layer 2 that is a core coder whose bit rate is 12 kbit/s.

In addition, it can be also seen from FIGS. 13A to 13D that even though the wideband audio signal coding device according to the exemplary embodiments has a low bit rate of 1.3 kbit/s compared to the G.729.1 layer 3 that is a standard wideband coder whose bit rate is 14 kbit/s, the wideband audio signal coding device may provide quality similar to that of the G.729.1 layer 3.

While the present invention has been particularly shown and described with reference to exemplary embodiments thereof, it will be understood by one of ordinary skill in the art that various changes in form and details may be made therein without departing from the spirit and scope of the present invention as defined by the following claims.

What is claimed is:

1. A wideband audio signal coding device comprising:

an enhancement layer configured to extract a first spectrum parameter from an inputted wideband signal having a first bandwidth, quantize the first spectrum parameter, and convert the first spectrum parameter into a second spectrum parameter; and a coding unit configured to extract a narrowband signal from the inputted wideband signal and code the narrowband signal based on the second spectrum parameter provided from the enhancement layer, wherein the narrowband signal has a second bandwidth smaller than the first bandwidth, and wherein the enhancement layer is configured to normalize the first spectrum parameter, apply an inverse discrete cosine transform (IDCT) to the normalized first spectrum parameter, convert the IDCT applied first spectrum parameter into an exponential scale to extract a frequency component, extract a narrowband spectrum having the second bandwidth from the frequency component, apply an inverse fast Fourier transform (IFFT) to the narrowband spectrum, and convert the IFFT applied narrowband spectrum into the second spectrum parameter using a Levinson-Durbin algorithm.

2. The wideband audio signal coding device of claim 1, wherein the first spectrum parameter comprises a mel-frequency cepstral coefficient (MFCC).

3. The wideband audio signal coding device of claim 1, wherein the second spectrum parameter comprises a linear prediction coefficient (LPC).

4. The wideband audio signal coding device of claim 1, further comprising:

a packet generating unit configured to packetize the quantized first spectrum parameter and the coded narrowband signal having the second bandwidth to generate a bit stream.

5. The wideband audio signal coding device of claim 1, wherein the coding unit comprises:

a narrowband signal extracting unit configured to low-pass-filter the inputted wideband signal having the first bandwidth and down-sample the low-pass-filtered signal to extract the narrowband signal having the second bandwidth; and a core coder configured to code the narrowband signal having the second bandwidth based on the second spectrum parameter.

6. A wideband audio signal decoding device comprising:

a first parameter converting unit configured to convert a first spectrum parameter into a second spectrum parameter having a first bandwidth;

a second parameter converting unit configured to convert the first spectrum parameter into a second spectrum parameter having a second bandwidth;

a core decoder configured to decode a coded bit stream to a signal having the second bandwidth based on the second spectrum parameter having the second bandwidth to generate an excitation signal having the second bandwidth; and a high frequency generating unit configured to restore a wideband signal having the first bandwidth based on the second spectrum parameter having the first bandwidth and the excitation signal having the second bandwidth, wherein the first parameter converting unit is configured to normalize the first spectrum parameter, apply an inverse discrete cosine transform (IDCT) to the normalized first spectrum parameter, convert the IDCT applied first spectrum parameter into an exponential scale to extract a frequency component, extract a spectrum having the first bandwidth from the frequency component, apply an inverse fast Fourier transform (IFFT) to the extracted spectrum, and convert the IFFT applied spectrum into the second spectrum parameter having the first bandwidth using a Levinson-Durbin algorithm.

7. The wideband audio signal decoding device of claim 6, further comprising:

a packet separating unit configured to separate a coded first spectrum parameter and the coded bit stream from an inputted bit stream; and a de-quantizing unit configured to de-quantize the coded first spectrum parameter to output the first spectrum parameter.

8. The wideband audio signal decoding device of claim 6, wherein the first spectrum parameter comprises a mel-frequency cepstral coefficient (MFCC).

9. The wideband audio signal decoding device of claim 6, wherein the second spectrum parameter having the first bandwidth comprises a first LPC and the second spectrum parameter having the second bandwidth comprises a second LPC whose order is lower than that of the first LPC.

10. The wideband audio signal decoding device of claim 6, wherein the high frequency generating unit comprises:

a wideband excitation signal generating unit configured to convert the excitation signal having the second bandwidth provided from the core decoder into an excitation signal having a third bandwidth;

a wideband parameter mixing unit configured to generate a high frequency signal having the third bandwidth using the excitation signal having the third bandwidth and the second spectrum parameter having the first bandwidth; and a post filtering unit configured to restore the wideband signal having the first bandwidth using the signal having the second bandwidth and the high frequency signal having the third bandwidth.

11. The wideband audio signal decoding device of claim 10, wherein the wideband excitation signal generating unit is configured to expand the excitation signal having the second bandwidth by interpolation, remove negative components from the interpolated excitation signal through half wave rectification, increase high frequency components through pre-emphasis, and convert the interpolated excitation signal whose high frequency components are increased into the excitation signal having the third bandwidth through the use of a high pass filter (HPF).

12. The wideband audio signal decoding device of claim 10, wherein the post filtering unit is configured to expand the signal having the second bandwidth into a signal having the first bandwidth by interpolation, limit the size of high frequency components of the signal having the first bandwidth by pre-emphasis, and restore the wideband signal having the first bandwidth using the high frequency signal having the third bandwidth and the signal having the first bandwidth and the high frequency components limited by the pre-emphasis.

13. A wideband audio signal coding method comprising:

extracting a first spectrum parameter from an inputted wideband signal having a first bandwidth;

quantizing the first spectrum parameter;

converting the first spectrum parameter into a second spectrum parameter; and coding a narrowband signal having the second bandwidth, which is extracted from the wideband signal having the first bandwidth, based on the second spectrum parameter, wherein the converting of the first spectrum parameter comprises:

normalizing the first spectrum parameter;

applying an inverse discrete cosine transform (IDCT) to the normalized first spectrum parameter;

converting the IDCT applied first spectrum parameter into an exponential scale to extract a frequency component;

extracting a narrowband spectrum having a predetermined bandwidth from the frequency component;

applying an inverse fast Fourier transform (IFFT) to the narrowband spectrum; and converting the IFFT applied narrowband spectrum into the second spectrum parameter using a Levinson-Durbin algorithm.

14. The wideband audio signal coding method of claim 13, wherein the first spectrum parameter comprises a mel-frequency cepstral coefficient (MFCC).

15. The wideband audio signal coding method of claim 13, wherein the second spectrum parameter comprises a linear prediction coefficient (LPC).

16. The wideband audio signal coding method of claim 13, further comprising:

packetizing the quantized first spectrum parameter and the coded narrowband signal having the second bandwidth to generate a bit stream.

17. The wideband audio signal coding method of claim 13, wherein the coding of the narrowband signal comprises:

low pass filtering the wideband signal having the first bandwidth; and down-sampling the low pass filtered wideband signal to extract the narrowband signal having the second bandwidth.

18. A wideband audio signal decoding method comprising:

converting a first spectrum parameter into a second spectrum parameter having a first bandwidth;

converting the first spectrum parameter into a second spectrum parameter having a second bandwidth;

decoding a coded bit stream to a signal having the second bandwidth based on the second spectrum parameter having the second bandwidth to generate an excitation signal having the second bandwidth; and restoring a wideband signal having the first bandwidth based on the second spectrum parameter having the first bandwidth and the excitation signal having the second bandwidth, wherein the converting of the first spectrum parameter comprises:

normalizing the first spectrum parameter;

applying an inverse discrete cosine transform (IDCT) to the normalized first spectrum parameter;

converting the IDCT applied first spectrum parameter into an exponential scale to extract a frequency component;

extracting a spectrum having the first bandwidth from the frequency component;

applying an inverse fast Fourier transform (IFFT) to the spectrum having the first bandwidth; and converting the IFFT applied spectrum into the second spectrum parameter having the first bandwidth using a Levinson-Durbin algorithm.

19. The wideband audio signal decoding method of claim 18, further comprising:

separating a coded first spectrum parameter and the coded bit stream from an inputted bit stream; and de-quantizing the coded first spectrum parameter to output the first spectrum parameter.

20. The wideband audio signal decoding method of claim 18, wherein the restoring of the wideband signal comprises:

converting the excitation signal having the second bandwidth into an excitation signal having a third bandwidth;

generating a high frequency signal having the third bandwidth using the excitation signal having the third bandwidth and the second spectrum parameter having the first bandwidth; and restoring the wideband signal having the first bandwidth using the signal having the second bandwidth and the high frequency signal having the third bandwidth.

21. The wideband audio signal decoding method of claim 20, wherein the converting of the excitation signal having the second bandwidth comprises:

expanding the excitation signal having the second bandwidth by interpolation;

removing negative components from the interpolated excitation signal through half wave rectifying;

increasing high frequency components of the interpolated excitation signal through pre-emphasis; and converting the interpolated excitation signal whose high frequency components are increased into an excitation signal having the third bandwidth through the use of a high pass filter.

* * * * *